US006997480B2

(12) United States Patent
Legrand

(10) Patent No.: US 6,997,480 B2
(45) Date of Patent: Feb. 14, 2006

(54) CORD LOCK DEVICE FOR BOOKS AND THE LIKE

(76) Inventor: Christian Noël Guy Legrand, 100/203 Mooban Chollada, District Ban Bua Thong, Nonthaburi Province 11110 (TH)

( * ) Notice: Subject to any disclaimer, the term of this patent is extended or adjusted under 35 U.S.C. 154(b) by 0 days.

(21) Appl. No.: 10/270,951

(22) Filed: Oct. 15, 2002

(65) Prior Publication Data

US 2004/0071495 A1 Apr. 15, 2004

(51) Int. Cl.
*B42D 1/00* (2006.01)

(52) U.S. Cl. ..... 281/21.1; 281/19.2; 292/1; 292/253

(58) Field of Classification Search ..... 446/147, 446/151, 487; 434/317; 292/1, 253, 246, 292/DIG. 16; 281/21.1, 19.2; 24/17 B, 24/17 R, 482, 542, 543; 229/125.38, 125.41, 229/289; 289/1.2

See application file for complete search history.

(56) References Cited

U.S. PATENT DOCUMENTS 837,449 A * 12/1906 Cowing ..... 24/67 R
1,028,380 A * 6/1912 Okamoto ..... 273/159
1,105,878 A * 8/1914 Celus ..... 273/159
1,841,310 A * 1/1932 Apffel ..... 84/471 R
4,828,289 A * 5/1989 Korner ..... 281/15.1
6,431,724 B1 * 8/2002 Tedham et al. ..... 362/154

* cited by examiner

*Primary Examiner*—Gary Estremesky
(74) *Attorney, Agent, or Firm*—Adam H. Jacobs

(57) ABSTRACT

A cord lock device for releasably securing a hinged object in a closed position includes a first cord loop projecting from a first side of a hinged object and a second cord loop projecting from a second side of a hinged object, the first and second cord loops projecting generally towards one another. The second cord loop includes an engagement loop section temporarily formed therein, the engagement loop section being extended through the first side of a hinged object adjacent one end of the first cord loop. The engagement loop section engages one end of the first cord loop, the one end of the first cord loop passing through the engagement loop section such that the first cord loop is intertwined with the second cord loop and thus the first and second cord loops cooperate to generally prevent access to the interior of a hinged object on which the first and second cord loops are mounted.

3 Claims, 2 Drawing Sheets

CORD LOCK DEVICE FOR BOOKS AND THE LIKE

BACKGROUND OF THE INVENTION

1. Technical Field

The present invention relates to locking devices for books and the like and, more particularly, to a cord-lock device having a first cord loop attached to the front page of the book cover and a second cord loop attached to the back book cover page, the cord loops being capable of being releasably intertwined with one another to alternately secure the book in a closed position or permit access to the internal contents of the book.

2. Description of the Prior Art

Locking devices for books and the like have been known for hundreds of years, with locking devices for doors and boxes even going farther back. Many different types of locking devices have been proposed and used with such objects, including such devices as latch-type locks, dead-bolts, padlocks, clasp securement systems and many others too numerous to name. More specific to the present invention, however, are such book locking devices such as clasps, small padlocks, and other such devices which are intended to prevent entry into a book or the like by unauthorized persons. With many such devices, however, it is necessary to remember a combination or retain a key in order to unlock the locking device and, if the combination is forgotten or the key is lost, it becomes impossible to open the book unless the locking device is broken. There is therefore a need for a locking device for books and the like which does not require a combination or key to open, yet provides some degree of security to prevent the contents of the book from being examined.

It has been found that many of the books sold with locking devices are sold to persons under the age of sixteen and, specifically, to children between the ages of ten and fourteen for purposes such as keeping a diary or other private writings. Of course, younger children may also wish to keep personal information in their book, but it is very unlikely that a young child will safely keep a key or remember a combination in order to access the interior of the book. But it is precisely at this age that the fundamentals of writing are taught and the use of those skills should be encouraged. Therefore, there is a need for an improved book locking device which can be used by younger individuals and that does not require the use of a combination or a key.

Therefore, an object of the present invention is to provide an improved cord-locking device for books and the like.

Another object of the present invention is to provide a cord-lock device which includes a pair of looped cords which, through manipulation of the cords, can be intertwined to prevent access to the interior of the book.

Another object of the present invention is to provide a cord-lock device which is attractive in appearance and relatively simple to use once the secret to the operation of the device is disclosed.

Another object of the present invention is to provide a cord-lock device which can be used not only on books but on many other objects having the possibility of being opened, including a box, chest, album, case, or any other such object.

Finally, an object of the present invention is to provide a cord-lock device which is relatively simple to install and operate, yet provides a good degree of protection to internal features of the book or other objects having the possibility of being opened due to the secret nature of the system.

SUMMARY OF THE INVENTION

The present invention provides a cord lock device for releasably securing a hinged object in a closed position, the cord lock device including a first cord loop projecting from a first side of a hinged object and a second cord loop projecting from a second side of a hinged object, the first and second cord loops projecting generally towards one another. The second cord loop includes an engagement loop section temporarily formed therein, the engagement loop section being extended through the first side of a hinged object adjacent one end of the first cord loop. The engagement loop section engages one end of the first cord loop, the one end of the first cord loop passing through the engagement loop section such that the first cord loop is intertwined with the second cord loop and thus the first and second cord loops cooperate to generally prevent access to the interior of a hinged object on which the first and second cord loops are mounted.

The improvements of the present invention over the prior art are easily seen and include that the cord lock device of the present invention does not require the use of a key or a combination to open the lock, thus eliminating the potential for loss of the key or combination. Furthermore, the elimination of the use of a key or combination renders the present invention usable for even young children who wish to be able to lock their private possessions but are too young for sophisticated locking devices now found in the prior art. Also, the appearance of the book or other object with which the present invention is used is significantly enhanced due to the use of the cord lock device of the present invention, and it is fully expected that various types of cords and colors of cords may be used which provide further enhancement to the book. Finally, because the cord and holes of the present invention may be made of any length, size or shape so long as the locking function is maintained, the restrictions on the size, thickness and shape of the book formerly dictated by the prior art locking devices and methods are substantially eliminated. It is therefore seen that the present invention provides a substantial improvement over those devices found in the prior art.

DESCRIPTION OF THE PREFERRED EMBODIMENT

Figure 1:
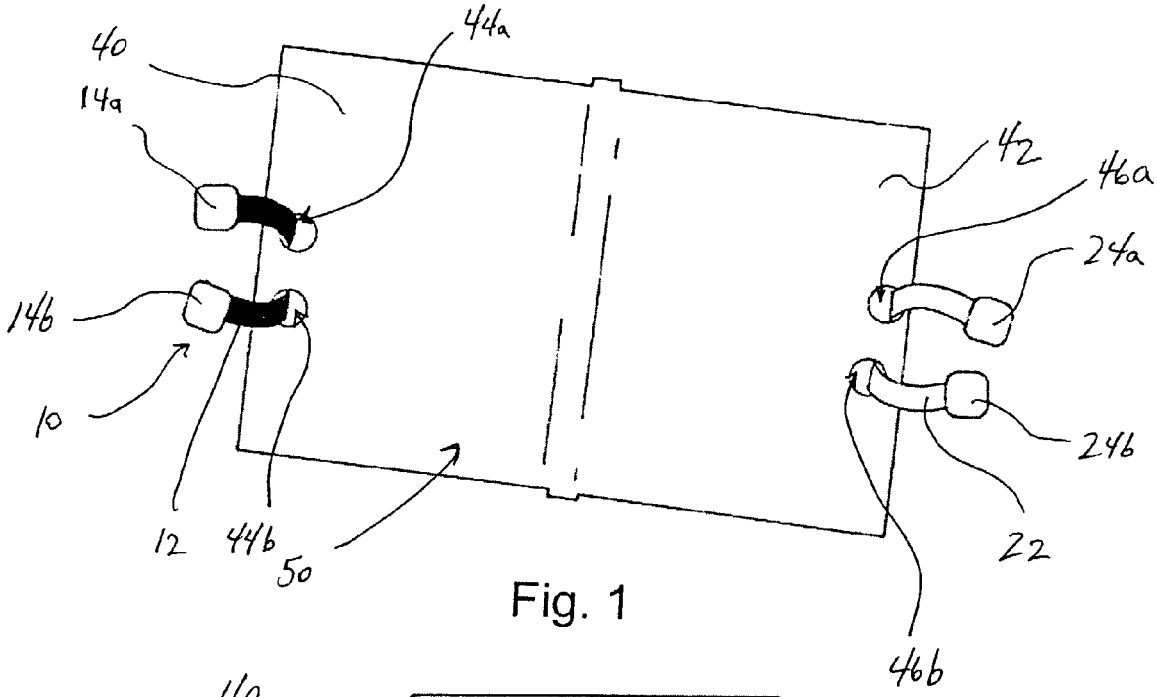
FIG. 1 is a top plan view of the cord lock device of the present invention mounted on a book.
Figure 2:
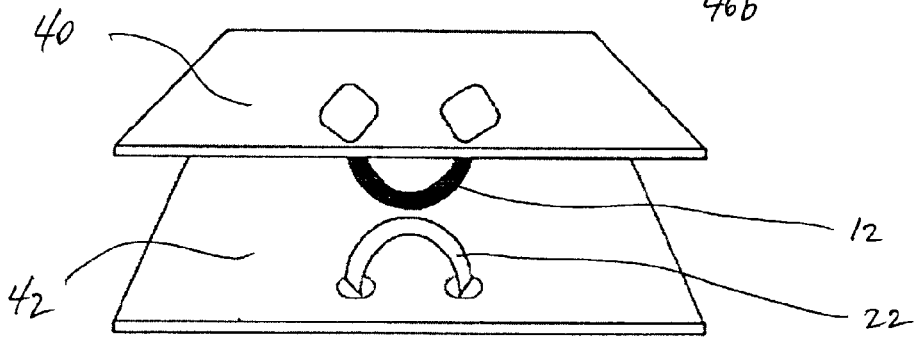
FIG. 2 is an end elevational view of the cord lock device of the present invention.
Figure 3:
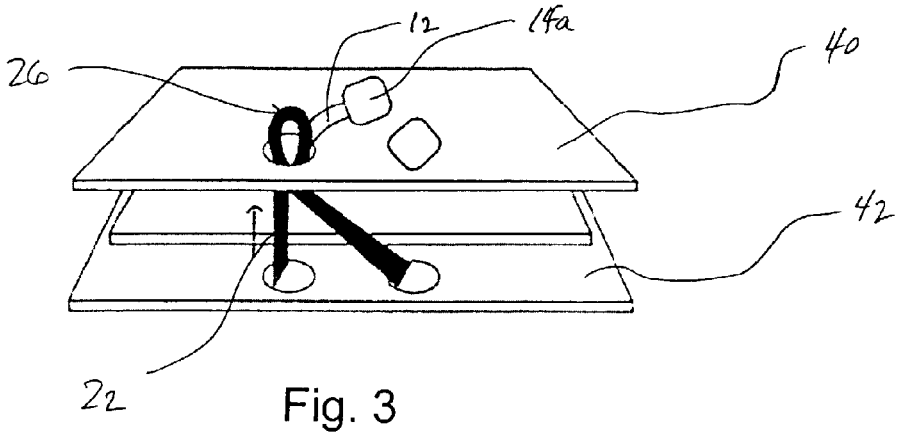
FIGS. 3, 4*a*, 4*b* and 5 are end elevational views of the cord lock device of the present invention showing the locking of the book.
Figure 4A:
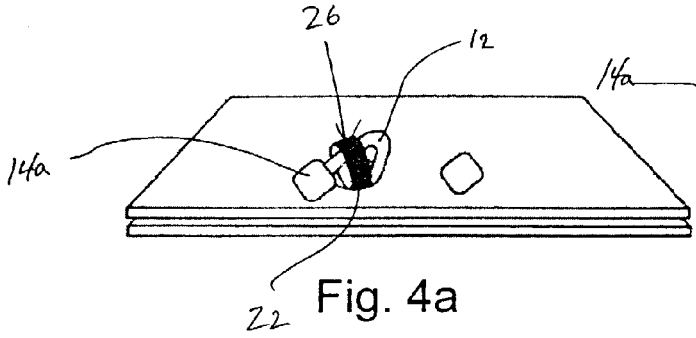
Figure 4B:
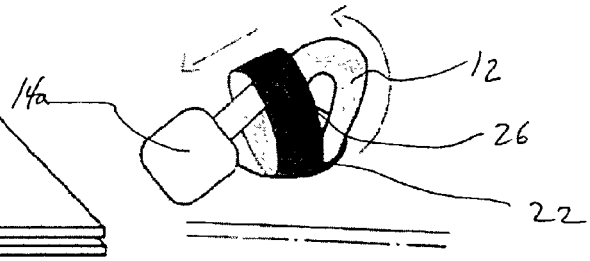

The cord lock device 10 of the present invention is shown best in FIGS. 1–5 as including a first cord loop 12 and a second cord loop 22 which are mounted on, respectively, first and second book cover pages 40 and 42. The first and second cord loops 12 and 22 are each preferably constructed of a flexible fabric, cord, ribbon, or string, and each may be of varying length depending on the thickness of the book 50 and the length of loop desired.

In the preferred embodiment, first book cover page 40 and second book cover page 42 would each include a pair of holes 44*a*, 44*b*, 46*a*, and 46*b*, formed in and extending through respectively the first and second book cover pages 40 and 42. First cord loop 12 would extend downwards through hole 44*a* and upwards through hole 44*b* with the ends of first cord loop 12 being knotted or having a pair of cord loop tips 14*a* and 14*b* attached to the ends of first cord loop 12 to prevent first cord loop 12 from falling out of the holes 44*a* and 44*b* in first book cover page 40. Likewise, second cord loop 22 would extend through holes 46*a* and 46*b* of second book cover page 42 and be secured therein by a pair of cord loop tips 24*a* and 24*b*, as shown best in FIGS. 1 and 2. It is an important feature of the cord lock device 10 of the present invention that the first and second cord loops 12 and 22 include at least one end which is movable within the hole 44*a* through which it extends in order to permit the invention to function correctly. Specifically, if second cord loop 22 is secured within holes 46*a* and 46*b* such that the second cord loop 22 cannot move within holes 46*a* and 46*b*, at least one end of first cord loop 12 must be free to move within one of the holes 44*a* and 44*b* of first book cover page 40. The purposes for this will be specified later in this disclosure.

Figure 5:
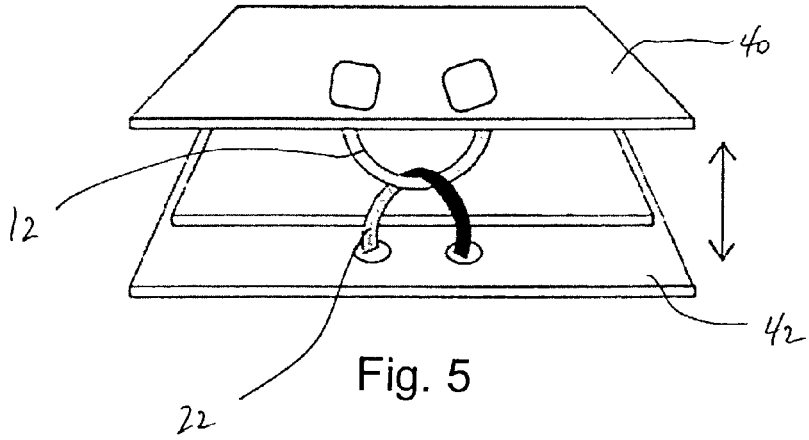

The cord lock device 10 of the present invention functions in the following manner. As shown best in FIGS. 3–5, the steps of using the cord lock device 10 of the present invention begin with the formation of a narrowed loop section 26 in second cord loop 22 which is inserted into and extended through hole 44*a* in first book cover page 40. Cord loop tip 14*a* of first cord loop 12 is then inserted through the narrowed loop section 26 of second cord loop 22, as shown best in FIGS. 4 and 5, such that cord loop tip 14*a* is on the opposite side of narrowed loop section 26 as the remainder of first cord loop 12. Second cord loop 22 is then released such that it falls downwards through hole 44*a* with the result being that the first cord loop 12 and second cord loop 22 are intertwined as shown in FIG. 5. It thus becomes impossible to open the book 50 due to the intertwined cord loops 12 and 22 which secure first book cover page 40 to second book cover page 42. By reversing the process as described above, the user of the invention is able to successfully disconnect second cord loop 22 from first cord loop 12 which would permit the book 50 to be opened. It should be further noted that each of the other ends of the cord loops 12 and 22 may be substituted for the cord loop tip 14*a* as described above, with substitutions of the appropriate elements to complete the intertwining of the cord loops 12 and 22 being understood by those familiar with the instant disclosure.

Of course, it is to be noted that numerous modifications, additions, and substitutions may be made to the cord lock device 10 of the present invention which falls within the intended broad scope of the appended claims. For example, the specific construction materials used in connection with the present invention are not critical so long as the functional characteristics of the invention are maintained. Furthermore, although the invention has been described as utilizing a loop being formed in second cord loop 22 to begin the process, a loop may be formed in first cord loop 12 and extended downwards to engage second cord loop 22 in substantially the same manner without affecting the intended functionality of the present invention. Furthermore, although it has been found that only a single end of one of the two cord loops need be free to move within the associated hole, such an arrangement would make it relatively easy for a person unfamiliar with the mechanism to determine how the mechanism functions. Therefore, it is preferred that each of the ends of the first and second cord loops 12 and 22 be free to move within the respective holes 44*a*, 44*b*, 46*a*, and 46*b*. Finally, although the present invention has been described for use in connection with a book, it may be used in connection with various other types of hinged devices, such as boxes, folders, albums, or substantially any other object having the possibility to be opened, such as a door, a case, or other such object. The minor modifications necessary to utilize the device of the present invention with such objects are contemplated as part of this disclosure and are covered by the appended claims.

There has therefore been shown and described a cord lock device which accomplishes at least all of its intended objectives.

I claim:

1. A cord lock device for releasably securing a book having front and rear covers in a closed position, said cord lock device comprising;

a first cord loop projecting from a first side of said book;

a second cord loop projecting from a second side of said book;

said first and second cord loops projecting generally towards one another;

said second cord loop having an engagement loop section temporarily formed therein, said engagement loop section being extended through said first side of said book adjacent one end of said first cord loop;

said engagement loop section engaging said one end of said first cord loop, said one end of said first cord loop passing through said engagement loop section such that said first cord loop is intertwined with said second cord loop; and said first and second cord loops cooperating to generally prevent access to the interior of said book on which said first and second cord loops are mounted.

2. The cord lock device of claim 1 wherein said one end of said first cord loop extends through one of two holes formed in said front cover of said book and the second end of said first cord loop extends through the second of said two holes with the loop section of said first cord loop depending downwards therefrom and the ends of said second cord loop each extending respectively through one of two holes formed in said rear cover of said book with the loop section of said second cord loop extending upwards therefrom.

3. A cord lock device for releasably securing a book having front and rear covers in a closed position, said cord lock device comprising;

a first cord loop projecting from a first side of said book;

a second cord loop projecting from a second side of said book;

said first and second cord loops projecting generally towards one another;

said second cord loop having an engagement loop section temporarily formed therein, said engagement loop section being extended through said first side of said book adjacent one end of said first cord loop;

said engagement loop section engaging said one end of said first cord loop, said one end of said first cord loop passing through said engagement loop section such that said first cord loop is intertwined with said second cord loop;

said first and second cord loops cooperating to generally prevent access to the interior of said book on which said first and second cord loops are mounted; and said one end of said first cord loop extending through one of two holes formed in a first side of said book and the second end of said first cord loop extends through the second of said two holes with the loop section of said first cord loop depending downwards therefrom and the ends of said second cord loop each extending respectively through one of two holes formed in a second side of said book with the loop section of said second cord loop extending upwards therefrom.

* * * * *